US005309998A

United States Patent [19]

Rivas et al.

[11] Patent Number: 5,309,998

[45] Date of Patent: May 10, 1994

[54] PUMPING SYSTEM INCLUDING FLOW DIRECTING SHOE

[75] Inventors: Olegario Rivas, Maracaibo; José L. Sandoval, San Antonio de Los Altos, both of Venezuela

[73] Assignee: Intevep, S.A., Caracas, Venezuela

[21] Appl. No.: 978,736

[22] Filed: Nov. 19, 1992

[51] Int. Cl.[5] ..... E21B 43/38

[52] U.S. Cl. ..... 166/265; 166/105.5; 166/369

[58] Field of Search ..... 166/369, 105.5, 105.6, 166/68, 265

[56] References Cited

U.S. PATENT DOCUMENTS

| | | | |
|---|---|---|---|
| 1,628,900 | 5/1927 | Neilsen | 166/105.5 |
| 2,433,942 | 1/1948 | Works | 166/313 |
| 2,488,931 | 11/1949 | Penick | 166/313 X |
| 2,748,719 | 6/1956 | Wells | 166/105.5 |
| 2,883,940 | 4/1959 | Gibson | 166/105.5 |
| 4,676,308 | 6/1987 | Chow et al. | 166/369 |
| 5,176,216 | 1/1993 | Slater et al. | 166/105.5 |

FOREIGN PATENT DOCUMENTS

| | | | |
|---|---|---|---|
| 688605 | 10/1979 | U.S.S.R. | 166/105.5 |
| 724693 | 3/1980 | U.S.S.R. | 166/105.5 |

*Primary Examiner*—Hoang C. Dang
*Attorney, Agent, or Firm*—Bachman & LaPointe

[57] ABSTRACT

A well pumping system for pumping a fluid having a liquid and a gas is disclosed which system includes a well casing and a production tube set within the well casing so as to define an annular space between the production tube and the well casing, the production tube including a shoe comprising a hollow tubular article having a substantially cylindrical wall defining a first flow passage, a second flow passage being formed within the wall of the shoe, the first flow passage having a first inlet for the liquid and a first outlet to the annular space, the second flow passage having a second inlet for the gas and a second outlet to the production tube, whereby the liquid is produced through the annular space and the gas is produced through the production tube. The pumping system preferably includes a pump for pumping the liquid to the first inlet, and a rod string for actuating the pump, the rod string being disposed within the production tube, whereby the rod string is substantially isolated from the liquid.

24 Claims, 5 Drawing Sheets

PUMPING SYSTEM INCLUDING FLOW DIRECTING SHOE

BACKGROUND OF THE INVENTION

The invention relates to the field of pumping fluids and, more particularly, to a system for pumping oil and gas from a subterranean well.

Conventional pumping systems utilize reciprocating subsurface pumps in order to produce fluids, namely oil and entrained and/or free gas, from a subterranean well to the surface. FIG. 1 illustrates a typical conventional system wherein fluids are passed through a downhole separator, separated gas is produced through the annular space defined between a production tube and a well casing of the subterranean well, and separated oil is produced through the production tube.

Reciprocating subsurface pumps are actuated by a rod string which passes through the production tube for connection with the subsurface pump. In situations where the oil produced is a viscous crude oil, the rod string is subjected to excessive friction and fatigue due to the viscous crude oil, which may cause rod failure and other serious problems such as damage to the pump, the production tube, the gear box and/or the surface stuffing box. Further, the increased friction on the rod string necessitates extra force to drive the rod string which in turn contributes further to the excess wear on the rod string. Additionally, viscous oil has the tendency to reduce the falling speed of the rod string due to flotation or buoyancy effects. This, of course, results in a decrease in pumping speed and a decrease in production and efficiency.

Numerous proposals have been made for dealing with the problem of reducing the friction and fatigue to which the rod string is subjected. FIG. 2 illustrates one proposed solution wherein low viscosity fluid is pumped down through the annular space to mix with heavy crude oil being produced through the production tube. The mixture has a reduced viscosity which results in less friction on the rod string. Nevertheless, this system requires the additional power required to pump the low viscosity fluid down the annular space, and also results in the production of an oil/low viscosity fluid mixture which must be separated at the surface. Additionally, typical subsurface pumps suffer from a decrease in pumping efficiency when operated on a mixture of liquid and gas. In the system of FIG. 2, the pump must act on oil, entrained gas, and the low viscosity fluid which may be additional gas, resulting in a loss of efficiency of the pump.

FIG. 3 illustrates another proposed solution wherein a low viscosity fluid is pumped through the production tube to mix with pumped oil and pass through a slotted pipe section to be produced through the annular space. As with the proposal of FIG. 2, however, additional power is required to pump the low viscosity fluid. Also, produced oil/fluid mixtures must be separated, and the subsurface pump must still act on oil and any entrained and/or free gas carried with the oil, thus reducing the efficiency of the system.

FIG. 4 illustrates another proposed solution wherein a shoe is disposed within the production tube and is sealed with a stuffing box so that oil and free and/or entrained gas produced through the pump are passed to the annular space for production. In the meantime, a low viscosity fluid is circulated through the production tube. This provides a reduction of the friction to which the rod string is subjected. However, the pump must still act on an oil/gas mixture resulting in a reduction in pumping efficiency. Further, fluids produced must still be separated at the surface.

It is desirable, therefore, to provide a system for pumping fluids wherein the rod string is not subjected to excessive friction, and wherein the subsurface pump does not suffer a loss in efficiency due to the pumping of gas along with oil, and further wherein produced oil, gas, and other fluids do not need to be separated at the surface.

It is, therefore, a principal object of the present invention to provide a pumping system wherein oil is produced through the annular space and gas is produced through the production tube so as to reduce or eliminate the effects of friction on the rod string.

It is a further object of the present invention to provide such a system which does not require the pumping of additional fluids into the well.

It is a still further object of the invention to provide a pumping system wherein oil and gas are separated downhole and produced separately so as to avoid the necessity of surface separation.

Other objects and advantages will appear hereinbelow.

SUMMARY OF THE INVENTION

The foregoing objects and advantages are readily obtained by a well pumping system for pumping fluids including liquid and gas which system comprises a well casing and a production tube set within the well casing so as to define an annular space between the production tube and the well casing, the production tube including a shoe comprising a hollow tubular article having a substantially cylindrical wall defining a first flow passage, a second flow passage being formed within the wall of the shoe, the first flow passage having a first inlet for the liquid and a first outlet to the annular space, the second flow passage having a second inlet for the gas and a second outlet to the production tube, whereby the liquid is produced through the annular space and the gas is produced through the production tube.

According to a preferred embodiment of the invention, the system further includes a pump for pumping the liquid to the first inlet, and a rod string for actuating the pump, the rod string being disposed within the production tube, whereby the rod string is substantially isolated from the liquid.

According to another preferred embodiment of the invention, the pump is connected to the production tube below the shoe so as to further define the annular space between the well casing and the pump, and the pumping system further comprises blocking means disposed in the annular space and dividing the annular space into an upper annular space and a lower annular space, the blocking means serving to block direct fluid flow between the upper annular space and the lower annular space. The blocking means preferably includes a packer located within the well casing between the first outlet of the first passage of the shoe and the inlets of the first and second passages of the shoe.

According to a still further preferred embodiment of the invention, the well pumping system further comprises means for separating a formation fluid into a liquid and a gas, and means for directing the liquid to the pump and for directing the gas to the second inlet.

BRIEF DESCRIPTION OF THE DRAWINGS

A detailed description of the preferred embodiments of the invention follows, with reference to the accompanying drawings, in which.

DETAILED DESCRIPTION OF THE PREFERRED EMBODIMENTS

The invention relates to a well pumping system for subterranean wells, particularly deep oil and gas producing wells.

Figure 5:
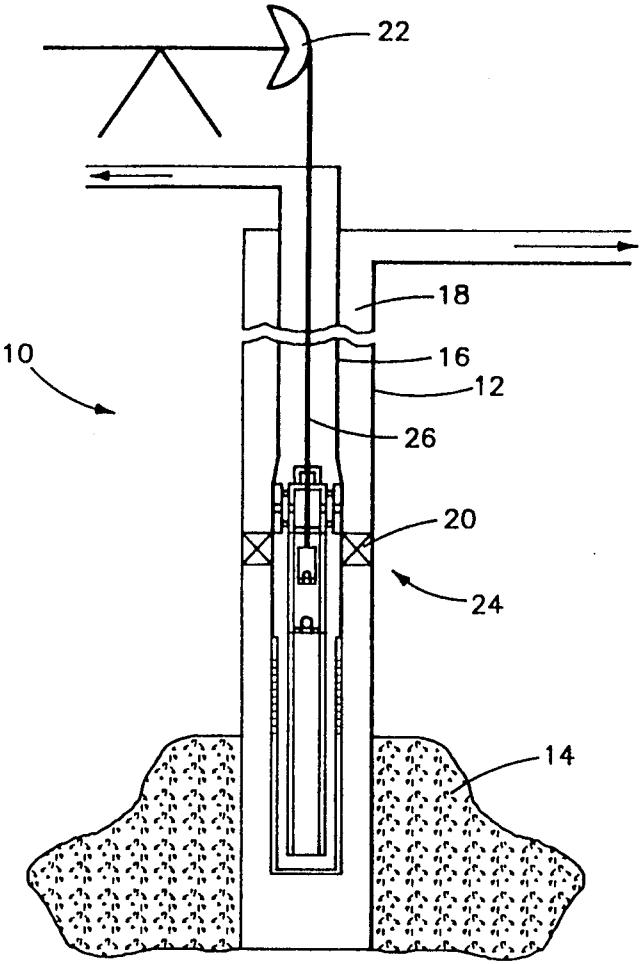
FIG. 5 is a schematic view of a pumping system according to the invention.

FIG. 5 illustrates a typical completed oil and gas producing well, generally referred to by reference numeral 10. Well 10 typically has a well casing 12 set into a producing formation 14. A production tube 16 is set within well casing 12, defining an annular space 18 between well casing 12 and production tube 16. A packer 20 is preferably set in the well to isolate a portion of annular space 18 from formation 14 as will be further discussed below. A prime mover 22 may preferably be disposed above well 10 to provide motive force to a pumping system 24 of the well. Motive force is typically supplied to pumping system 24 through a rod string 26, disposed through production tube 16 as shown.

It is the principle object of the present invention to provide a pumping system 24 which reduces or eliminates friction and fatigue caused on rod string 26 by liquids produced through production tube 16, especially viscous crude oils, so as to prolong the service life of the rod string 26 and enhance pumping efficiency.

Figure 3:
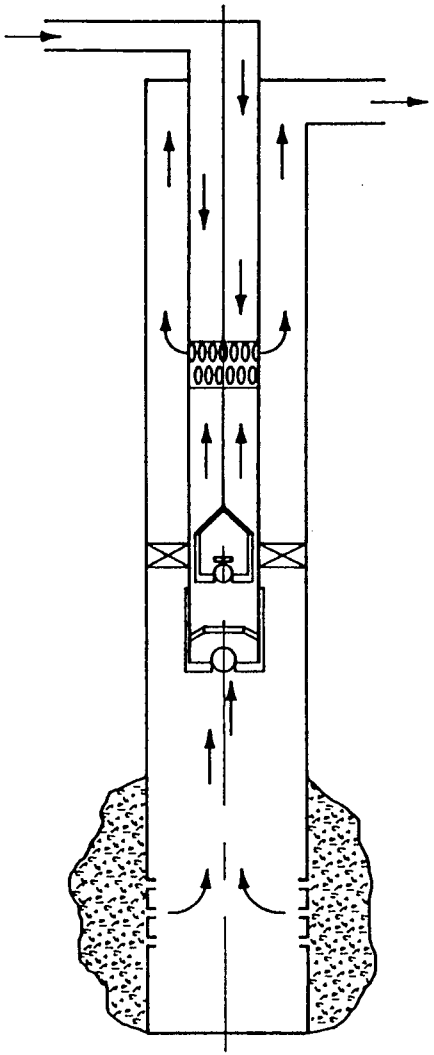
FIG-3 (PRIOR ART)
FIGS. 1–4 illustrate prior art pumping systems.
Figure 2:
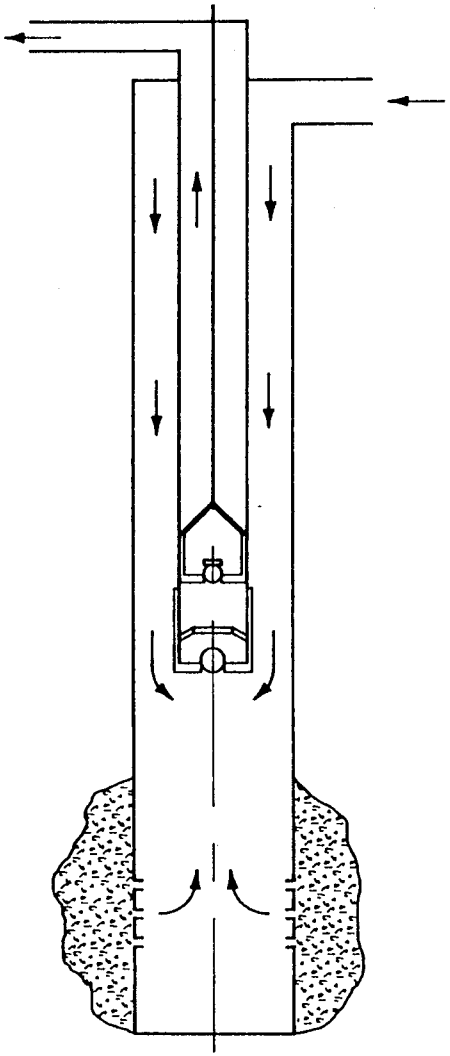
FIG-2 (PRIOR ART)
Figure 1:
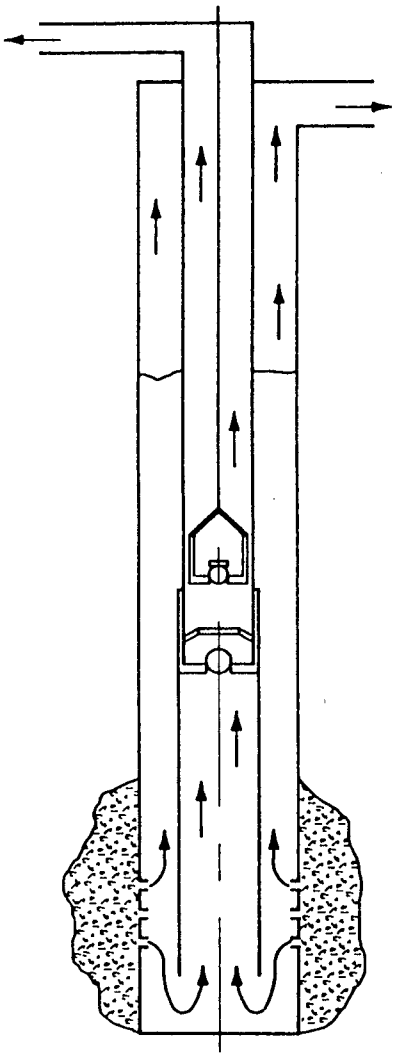
FIG-1 (PRIOR ART)
Figure 4:
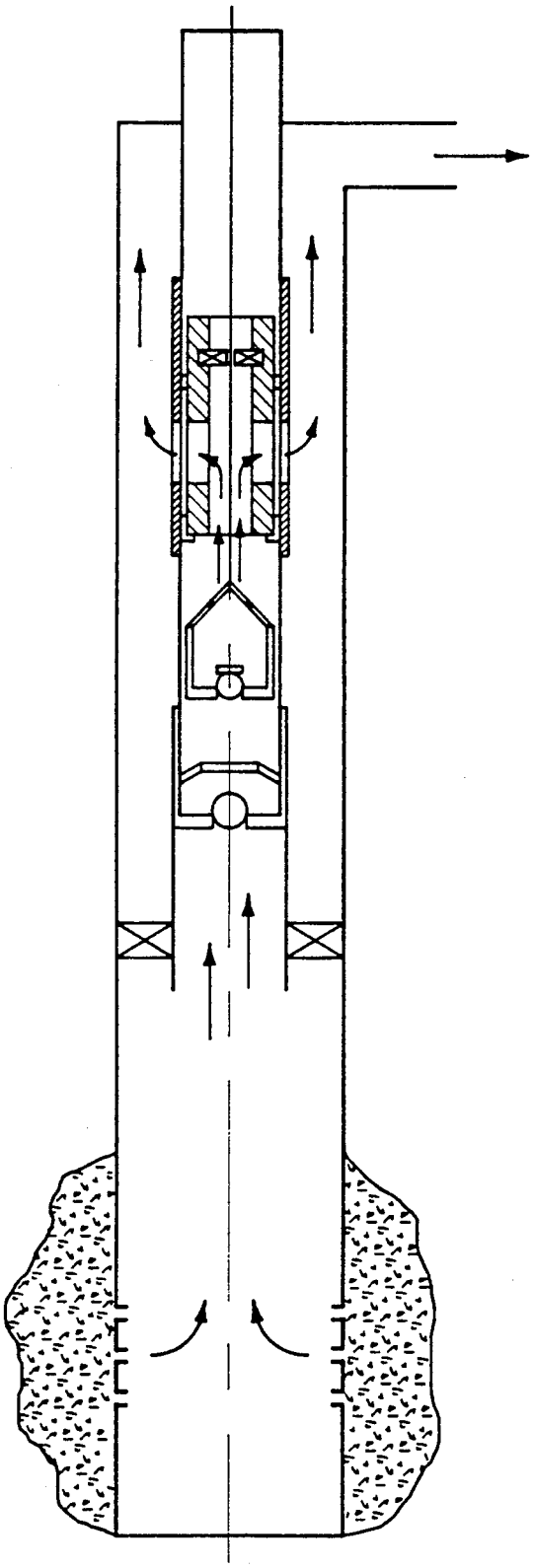
FIG—4 (PRIOR ART)
Figure 6:
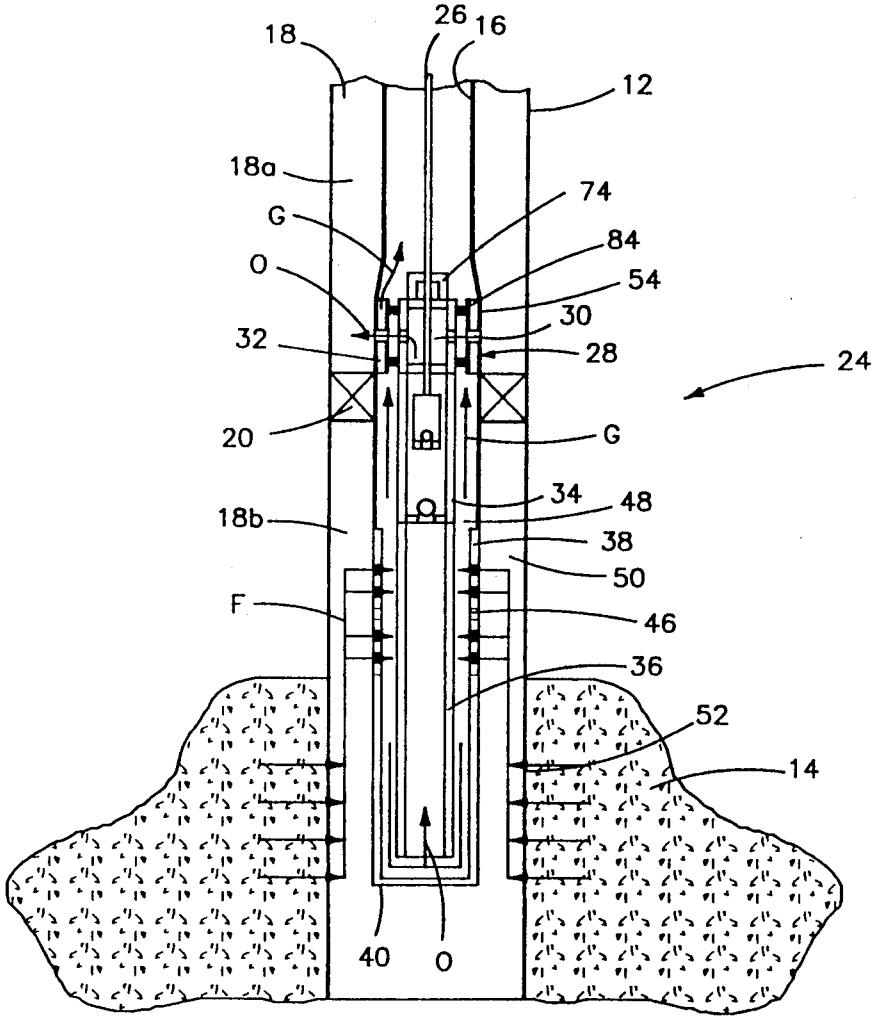
FIG. 6 is a detailed schematic view of the production equipment of the pumping system of FIG. 5.

FIG. 6 is an enlarged illustration of the lower end of well 10, showing the various elements of pumping system 24 according to the invention.

According to the invention, production tube 16 includes a flow directing shoe 28 having a first flow passage 30 and a second flow passage 32 which serve to direct the flow of liquid and gas from a producing formation so as to produce liquid through annular space 18 and to produce gas through production tube 16. In this way, rod string 26 is substantially isolated from the liquid and is, therefore, substantially isolated from the friction and fatigue associated therewith. The structure and function of shoe 28 will be further described hereinbelow with reference to FIG. 7.

Still referring to FIG. 6, a subsurface pump 34 is preferably connected to production tube 16, below shoe 28, so as to further define annular space 18 between pump 34 and Well casing 12. Conventional pumps typically have a suction tube 36 extending from the bottom of the pump 34. Suction tube 36 serves to still further define annular space 18. Pump 34 serves to pump liquid to first flow passage 30. Pump 34 is actuated by rod string 26 which is connected at the surface to prime mover 22.

Packer 20, as previously mentioned, is preferably located within well casing 12 and divides annular space 18 into an upper annular space 18*a* and a lower annular space 18*b*. Packer 20 serves to block direct flow from lower annular space 18*b* to upper annular space 18*a*. Fluids will, of course, flow indirectly from lower annular space 18*b* to upper annular space 18*a*, by flowing through shoe 28 in accordance with the present invention.

A separator 38 is preferably connected to production tube 16 below shoe 28 and pump 34. Separator 38 may suitably be any type of conventional separating means, and may preferably be a downhole separator such as that disclosed in U.S. Pat. application Ser. No. 07/863,018, filed Apr. 3, 1992, now the U.S. Pat. No. 5,240,073, and assigned to the assignee of the present application.

Separator 38 serves to separate formation or reservoir fluids F into liquid or oil O and gas G components. Of course, each contain remnants of the other, but preferably not in amounts sufficient to interfere with the operation of the pumping system. It is further noted that the oil component will occasionally, if not usually, include other liquids as well. This mixture of oil and other liquids is referred to herein alternatively as the oil component and/or the liquid component of the produced or reservoir fluid.

Separator 38 may preferably be a hollow tubular article having a substantially cylindrical wall 42, a closed bottom 40 and a fluid inlet 46 passing through wall 42 of separator 38. Separator 38 divides lower annular space 18*b* into an inner chamber 48 defined between wall 42 and pump 34 and an outer chamber 50 defined between well casing 12 and wall 42. Reservoir fluids typically enter outer chamber 50 from formation 14 through perforations 52 preferably located in well casing 12. Fluid inlet 46 serves to allow fluids F to enter inner chamber 48 from outer chamber 50. Inner chamber 48 communicates with second flow passage 32 of shoe 28 above fluid inlet 46. Inner chamber 48 also communicates with pump 34 below fluid inlet 46. In this manner, fluid enters inner chamber 48 through fluid inlet 46, where gas and liquid are substantially separated, and gas flows upward to second flow passage 32 of shoe 28, while liquid flows downward to be drawn through pump 34 substantially, and advantageously, free of gas. Fluid inlet 46 may suitably be one or more conventional perforations in the wall 42 of separator 38, or any other conventional structure or means for allowing fluid flow through wall 42 of separator 38.

It should be noted that separating means such as downhole separator 38 serve to separate produced fluid F into the gas G component and the liquid component 0, and also to direct the components to the proper inlets of shoe 28. Separating means, of course, may not be necessary in situations where gas and liquid components are already substantially separated. Further, it should be clear that where separating means are to be used, any conventional or known structure should be suitable.

Figure 7:
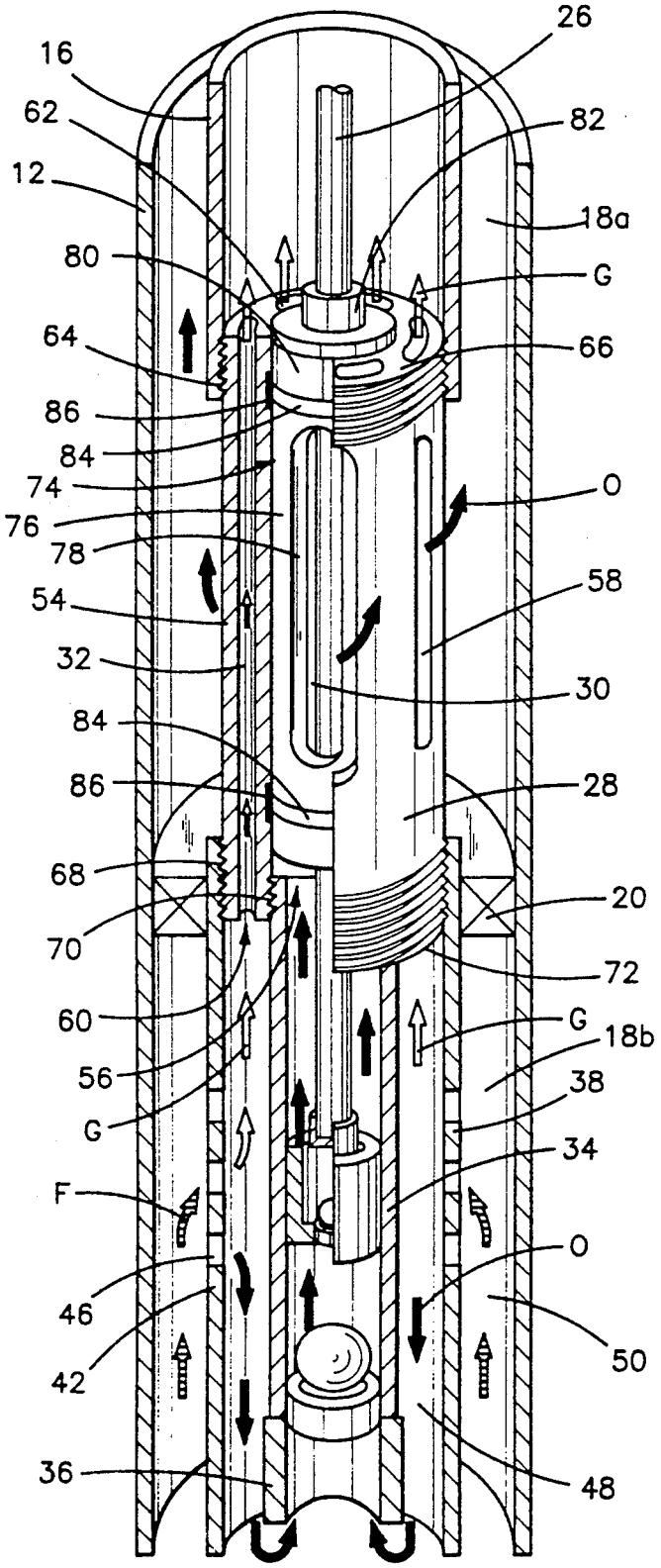
FIG. 7 is a partial sectional view of a flow directing shoe and associated pumping equipment of a pumping system according to the invention.

Referring now to FIG. 7, the structure and function of a preferred embodiment of flow directing shoe 28, according to the invention, will be described. Shoe 28 comprises a hollow tubular article having a substantially cylindrical wall 54 defining first flow passage 30 having a first inlet 56 and a first outlet 58. Second flow passage 32 is also preferably formed in wall 54 and has a second inlet 60 and a second outlet 62. First inlet 56 serves as a liquid inlet and receives liquid from pump 34, while second inlet 60 serves as a gas inlet. First outlet 58 passes radially through wall 54 of shoe 28 to upper annular space 18*a*. Second outlet 62 opens to production tube 16. Shoe 28 may preferably have external threads 64 at a top end 66, for connection with production tube 16. Shoe 28 may also preferably have both external threads 68 and internal threads 70 at a bottom end 72, for connection to separator 38 and pump 34 respectively.

First outlet 58 of first passage 30 is preferably at least one radial bore which extends radially through wall 54 of shoe 28, so as to provide communication between pump 34, through first passage 30, to upper annular space 18*a*.

Second flow passage 32 of shoe 28 may preferably include at least one longitudinal bore formed lengthwise within the wall 54 of shoe 28, connecting top end 66 with bottom end 72. In this manner, second flow passage 32 serves to provide communication between inner chamber 48 and production tube 16. Second inlet 60 of second passage 32 is preferably located at bottom end 72 of shoe 28, while second outlet 62 is preferably located at top end 66 of shoe 28.

The inlets and outlets of shoe 28 also further define the suitable location of packer 20 as follows. Packer 20 is disposed through any conventional manner at a location within the well casing which is preferably between first outlet 58 of first flow passage 30 and inlets 56, 60 of first and second flow passages 30, 32. In this manner, fluids are prevented from bypassing the inlets 56, 60 and flowing directly to upper annular space 18*a*. It should be appreciated, of course, that this positioning of the packer 20 allows the packer to be set between the well casing 12 on the one hand, and any one of the production tube 16, shoe 28 and pump 34 on the other hand, depending upon the position between the aforesaid inlets and outlet at which the packer is to be set.

It should be noted that shoe 28 could be formed as an integral part of a section of production tube 16, or could be provided as a separate section to be connected to the production tube 16 as described above with reference to external threads 64, or through any other conventional connection means.

Top end 66 of shoe 28 is preferably closed off so as to prevent flow from pump 34 through shoe 28 to production tube 16. Such flow would, of course, defeat the purpose of transferring the liquid from pump 34 to upper annular space 18*a*. Top end 66 of shoe 28 may preferably be closed off by disposing a stuffing box 74 within shoe 28. Stuffing box 74 may be any means known in the art for sealingly closing off top end 66 of shoe 28 around rod string 26, and preferably comprises a hollow tubular article having a substantially cylindrical wall 76, and having at least one flow passage 78 formed in wall 76. Flow passage 78 preferably aligns with first outlet 58 of first passage 30. Stuffing box 74 is closed off at a top end 80 by a cover 82 through which rod string 26 sealingly and slidably passes. Any suitable material may be disposed within cover 82 and stuffing box 74 so as to provide a seal with rod string 26.

Stuffing box 74 may preferably have at least one seal ring 60 disposed around a circumference thereof. Shoe 28 also preferably has at least one seat 86 disposed around an inner circumference thereof so as to interact with seal ring 84 of stuffing box 74 to position and seal stuffing box 74 in position in shoe 28. As shown, shoe 28 preferably has two seats 86, one above and one below the extent of first outlet 58 of first passage 30. Stuffing box 74 preferably has two seal rings 84, preferably disposed above and below the extent of flow passage 78. Seal rings 84 and seats 86 are preferably arranged so that stuffing box 74 can be slidably disposed within shoe 28, and further so that flow passages 78 of stuffing box 74 align with first outlet 58 of shoe 28 when stuffing box 74 is seated in shoe 28. Thus, oil O flowing from pump 34 enters stuffing box 74 within shoe 28, as shown in FIG. 7 by arrows 0, and passes through first passage 30 including flow passage 78 of stuffing box 74, and thence through first outlet 58 to enter upper annular space 18*a*.

As shown in FIG. 7, the connection of pump 34 and separator 38 to shoe 28 aligns inner chamber 48 with bottom end 72 of shoe 28 and, therefore, with second inlet 60, the gas inlet, of second flow passage 32. Further, the connection of shoe 28 to production tube 16 aligns the top end 66 of shoe 28, and therefore second outlet 62 of second passage 32, with production tube 16. Thus, gas flowing from inner chamber 48 enters second inlet 60 of second flow passage 32 and flows to production tube 16 as shown by the arrows G in FIG. 7.

Figure 8:
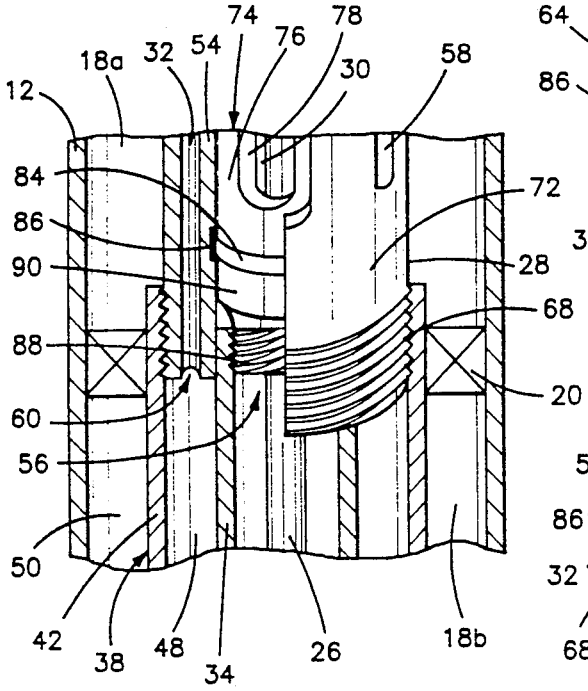
FIG. 8 is a partial sectional view of an alternate embodiment of the system of FIG. 7 for use with an insertable pump.

FIG. 8 illustrates an alternate embodiment of the invention, wherein pump 34 is an insertable pump. Such a pump has a smaller diameter and is more readily connected to stuffing box 74. Thus, according to this embodiment of the invention, stuffing box 74 may have external threads 88 disposed around a circumference of a bottom end 90 thereof, for connection with the insertable pump. All other features of this embodiment are substantially the same as those discussed with reference to FIG. 7.

Figure 9:
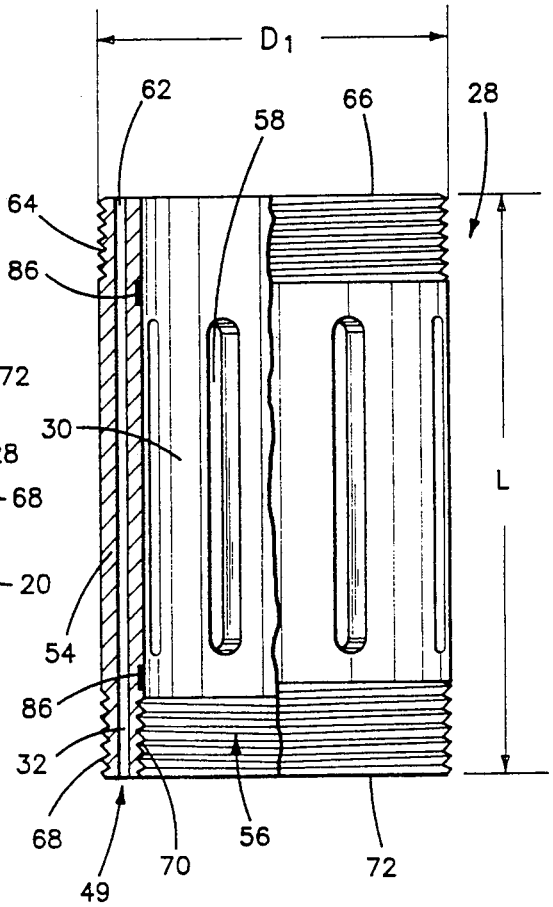
FIG. 9 is a side view, partially in section, of a flow direct shoe according to the invention.
Figure 11:
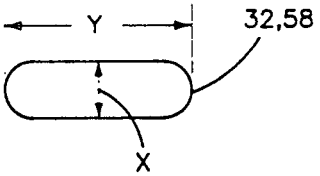
FIG. 11 illustrates the dimensions of a flow passage of a flow directing shoe according to the invention.
Figure 10:
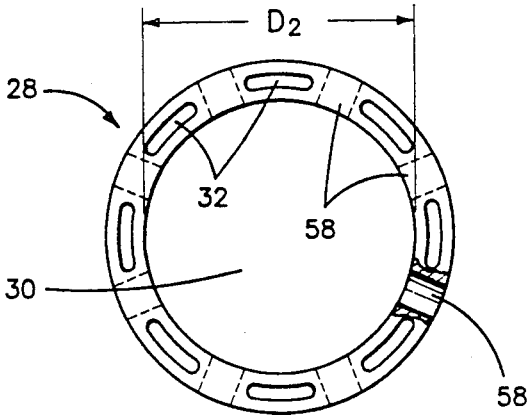
FIG. 10 is an end view, partially in section, of the flow directing shoe the of FIG. 9.

FIGS. 9–11 show additional views of flow directing shoe 28, and provide further illustration of flow passages 30, 32 including respective inlets 56, 60 and outlets 58, 62.

The number and size of second flow passage 32 and first outlet 58 depends upon the relative volumes of gas and oil which are expected from a particular well. Once this ratio has been determined, thus determining the necessary flow area for each component, the proper size for flow passages or outlets having a shape as shown in FIG. 11 can be determined by the following equation:

$$A=(\pi/4x^2+yx-x^2)N$$

wherein:

A is the desired flow area;

x is the width of the passage, as shown in FIG. 11;

y is the length of the passage,

N is the number of passages to be provided in the shoe.

The maximum area which can be devoted to flow passages is, of course, limited by the total area of the wall 54 of the shoe 28. Thus, the maximum possible flow area $A_L$ for the longitudinal second passages 32 must be less than $Ar=\pi/4(D_1^2-D_2^2)$, wherein $D_1$ is the outside diameter of shoe 28 and $D_2$ is the inner diameter of shoe 28. These diameters are indicated in FIGS. 9 and 10. The maximum area $A_R$ for the radial first outlets 58 must be less than $A_R=\pi D_1 L$, wherein $D_1$ is the outside diameter of the shoe 28, and L is the length of the shoe 28, also as shown in FIGS. 9–10. Of course, the size and number of second flow passage 32 should be determined also taking the size and number of first outlets 58 into account, and vice versa, since both occupy the wall of shoe 28.

Referring back to FIGS. 6–7, the operation of the pumping system according to the invention will be described.

As shown in FIG. 6, fluids F produced from formation 14 pass through separator 38 and are separated into oil O and gas G components. As shown in FIG. 7, gas G rises through inner chamber 48, enters second inlet 60 of second passage 32 of shoe 28, and passes through second outlet 62 to production tube 16, where it is produced to the surface without passing through pump 34. Oil O drops inside inner chamber 48 and is drawn into pump 34 through suction tube 36. Oil O is pumped through first inlet 56 of first passage 30 to first outlet 58 which passes the oil to upper annular space 18*a*, where it is produced to the surface without affecting rod string 26.

Thus, according to the invention, oil and gas are separated into components. The flow directing shoe 28 transmits the rising gas component to the production tube 16 and transmits the oil component from the pump 34 to the upper annular space 18*a*. It is apparent, therefore, that friction to the rod string 26 caused by crude oil flowing in the production tube 16 is substantially eliminated by the pumping system of the present invention, along with the various problems associated with this friction as set forth above. Further, flow directing shoe 28 transmits gas G directly to production tube 16, bypassing pump 34, which therefore operates at a better efficiency.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A well pumping system for pumping a fluid including a liquid and a gas, the system comprising:

a well casing;

a production tube set within the well casing so as to define an annular space between the production tube and the well casing, the production tube including a shoe comprising a hollow tubular article having a substantially cylindrical wall defining a first flow passage, a second flow passage being formed within the wall of the shoe, the first flow passage having a first inlet for the liquid and a first outlet to the annular space, the second flow passage having a second inlet for the gas and a second outlet to the production tube, whereby the liquid is produced through the annular space and the gas is produced through the production tube;

a pump for pumping the liquid to the first inlet; and a rod string for actuating the pump, the rod string being disposed within the production tube, whereby the rod string is substantially isolated from the liquid.

2. A well pumping system according to claim 1, wherein the pump is connected to the production tube below the shoe so as to further define the annular space between the well casing and the pump, the pumping system further comprising blocking means disposed in the annular space and dividing the annular space into an upper annular space and a lower annular space, the blocking means serving to block direct fluid flow between the upper annular space and the lower annular space.

3. A well pumping system according to claim 2, wherein the blocking means comprises a packer located within the well casing between the first outlet of the first passage of the shoe and the inlets of the first and second passages of the shoe.

4. A well pumping system, according to claim 3, further comprising means for directing the liquid to the pump and for directing the gas to the second inlet.

5. A well pumping system, according to claim 3, further comprising means for separating a formation fluid into a liquid and a gas, and means for directing the liquid to the pump and for directing the gas to the second inlet.

6. A well pumping system according to claim 5, wherein the separating and directing means comprise a separator disposed in the lower annular space so as to divide the lower annular space into an outer chamber defined between the well casing and the separator, and an inner chamber defined between the separator and the pump.

7. A well pumping system according to claim 6, wherein the separator comprises a hollow tubular article having a substantially cylindrical wall, a closed bottom, and a fluid inlet passing through the wall of the separator so as to communicate the outer chamber with the inner chamber, the inner chamber communicating with the second inlet of the shoe above the fluid inlet, and the inner chamber communicating with the pump below the fluid inlet, whereby the fluid is separated at the fluid inlet into the gas which flow upward to the second inlet of the shoe, and into the liquid which flows downward to the pump.

8. A well pumping system according to claim 1, wherein the first outlet includes at least one radial bore passing through the wall of the shoe.

9. A well pumping system according to claim 8, wherein the second flow passage comprises at least one longitudinal bore formed lengthwise within the wall of the shoe.

10. A well pumping system according to claim 9, further comprising means for sealing an upper end of the shoe, the rod string being slidably and sealingly disposed through the sealing means.

11. A well pumping system according to claim 10, wherein the sealing means includes a stuffing box sealingly associated with the upper end of the shoe, the stuffing box comprising a hollow tubular article having a substantially cylindrical wall, the wall of the stuffing box having at least one flow passage in alignment with the first outlet of the first flow passage of the shoe.

12. A well pumping system according to claim 11, wherein the shoe has seats disposed on an inner surface thereof, above and below the first outlet, and wherein the stuffing box is disposed within the shoe and has seal rings disposed for interaction with the seats whereby the stuffing box is sealingly held in place.

13. A flow directing shoe comprising:

a hollow tubular having a substantially cylindrical wall defining a first flow passage, a second flow passage being formed within the wall of the shoe, the first flow passage having a first inlet and a first outlet, the first outlet passing radially through the wall of the shoe, the second flow passage having a second inlet and a second outlet, the second outlet being located at an end of the shoe and wherein the shoe has a first end and a second end, the first inlet and the second inlet being located at the first end of the shoe, the second outlet being located at the second end of the shoe; and a stuffing box comprising an additional tubular article associated with the shoe so as to seal the second end of the shoe.

14. A shoe according to claim 13, wherein the stuffing box has at least one flow passage in alignment with the first outlet of the shoe.

15. A shoe according to claim 14, wherein the shoe has seats disposed on an inner surface thereof, above and below the first outlet, and wherein the stuffing box is disposed within the shoe and has seal rings disposed for interaction with the seats whereby the stuffing box is sealingly held in place.

16. A shoe according to claim 13, wherein the first outlet comprises at least one radial bore passing radially through the wall of the shoe.

17. A shoe according to claim 16, wherein the second flow passage comprises at least one longitudinal bore formed lengthwise within the wall of the shoe.

18. A method for pumping a fluid including a liquid and a gas from a well, the method comprising the steps of:

providing a well casing in the well;

providing a production tube within the well casing so as to define an annular space between the well casing and the production tube, the production tube including a shoe comprising a hollow tubular article having a substantially cylindrical wall defining a first flow passage, a second flow passage being formed within the wall of the shoe, the first flow passage having a first inlet for the liquid and a first outlet to the annular space, the second flow passage having a second inlet for a gas and a second outlet to the production tube;

directing the liquid to the first inlet of the shoe; and directing the gas to the second inlet of the shoe, whereby the liquid is produced through the annular space and the gas is produced through the production tube.

19. A method according to claim 18, further including the steps of:

positioning a pump in the well casing so as to further define the annular space between the well casing and the pump, the pump being connected to the production tube below the shoe;

providing a rod string for actuating the pump, the rod string being disposed within the production tube and connected to the pump, whereby the rod string is substantially isolated from the liquid.

20. A method according to claim 19, further including the steps of positioning a packer within the well casing so as to divide the annular space into an upper annular space and a lower annular space, the packer blocking direct flow between the upper annular space and the lower annular space.

21. A method according to claim 20, further including the step of positioning the packer between the first outlet of the first passage of the shoe and the inlets of the first and second passages of the shoe.

22. A method according to claim 21, further including the step of separating the fluid into the liquid and the gas, directing the liquid to the pump, and directing the gas to the second inlet.

23. A method according to claim 22, further including the steps of positioning a separator in the well casing below the pump so as to divide the lower annular space into an outer chamber and an inner chamber, the separator comprising a hollow tubular article having a substantially cylindrical wall, a closed bottom, and a fluid passage passing through the wall of the separator so as to communicate the outer chamber with the inner chamber, the inner chamber communicating with the second inlet of the shoe above fluid passage, and the inner chamber communicating with the pump below the fluid passage, whereby the fluid is separated at the fluid passage into the gas which flows upward to the second inlet of the shoe, and into the liquid which flows downward to the pump.

24. A method according to claim 23, further including the step of providing a stuffing box within the shoe so as to seal an upper end of the shoe.

* * * * *